US008545373B2

(12) United States Patent
Borden

(10) Patent No.: US 8,545,373 B2
(45) Date of Patent: Oct. 1, 2013

(54) SHOULDER STRETCHER AND METHOD OF USE

(76) Inventor: Peter Scott Borden, Torrance, CA (US)

( * ) Notice: Subject to any disclaimer, the term of this patent is extended or adjusted under 35 U.S.C. 154(b) by 546 days.

(21) Appl. No.: 12/684,961

(22) Filed: Jan. 10, 2010

(65) Prior Publication Data

US 2010/0234776 A1 Sep. 16, 2010

Related U.S. Application Data

(63) Continuation-in-part of application No. PCT/US2008/066509, filed on Jun. 11, 2008.

(60) Provisional application No. 60/949,480, filed on Jul. 12, 2007.

(51) Int. Cl.
*A61H 1/02* (2006.01)
*A63B 21/002* (2006.01)
*A63B 23/02* (2006.01)

(52) U.S. Cl.
USPC ..... 482/91; 482/92; 482/131; 482/137; 482/905; 482/907; 601/33; 602/20

(58) Field of Classification Search
USPC ..... 482/148, 907, 123, 905, 130, 136, 482/91, 92, 142, 131, 44, 46, 127, 137; 601/5, 601/33, 133, 23, 24; 128/845, DIG. 19; 273/452; 602/20, 32; 606/241; 600/587, 600/595; 33/511, 512; 73/865.4, 379.01, 73/847
See application file for complete search history.

(56) References Cited

U.S. PATENT DOCUMENTS

| | | | | | |
|---|---|---|---|---|---|
| 911,925 | A * | 2/1909 | del Valle y Zeno | 73/379.08 |
| 1,007,526 | A * | 10/1911 | Caro | 601/33 |
| 2,590,739 | A * | 3/1952 | Wagner et al. | 602/39 |
| 2,921,791 | A * | 1/1960 | Berne | 482/118 |
| 3,089,700 | A * | 5/1963 | Hotas | 482/94 |
| 3,495,824 | A * | 2/1970 | Cuinier | 482/113 |
| 3,953,025 | A * | 4/1976 | Mazman | 482/118 |
| 3,982,757 | A * | 9/1976 | McDonnell | 482/123 |
| 4,209,167 | A * | 6/1980 | Jansen | 482/123 |
| 4,772,015 | A * | 9/1988 | Carlson et al. | 482/92 |
| 4,846,468 | A * | 7/1989 | McCoy et al. | 273/451 |
| 4,957,281 | A * | 9/1990 | Christolear, Jr. | 482/100 |
| 5,062,633 | A * | 11/1991 | Engel et al. | 482/118 |
| 5,391,132 | A * | 2/1995 | Greenwald | 482/91 |
| 5,480,368 | A * | 1/1996 | Huang | 482/123 |
| 5,611,764 | A * | 3/1997 | Bonutti et al. | 482/124 |
| 5,645,521 | A * | 7/1997 | Hepburn et al. | 601/33 |
| 6,007,500 | A * | 12/1999 | Quintinskie, Jr. | 601/5 |
| 6,113,562 | A * | 9/2000 | Bonutti et al. | 602/20 |
| 6,497,640 | B2 * | 12/2002 | Loft et al. | 482/115 |

(Continued)

FOREIGN PATENT DOCUMENTS

DE 296 22 407 U 1 * 12/1996

*Primary Examiner* — Loan Thanh
*Assistant Examiner* — Victor K Hwang
(74) *Attorney, Agent, or Firm* — Lewis Brisbois Bisgaard & Smith LLP; Jon E. Hokanson

(57) ABSTRACT

A human shoulder stretcher and method of use for gradual, progressive posterior capsular stretching to rehabilitate the shoulder, in particular to address tightness of the posterior capsule of the glenohumeral joint through use of a lever arm and ratcheting mechanism that permits a patient to stretch his or her shoulder without the need for a therapist present.

15 Claims, 18 Drawing Sheets

(56) References Cited

U.S. PATENT DOCUMENTS

| | | | | |
|---|---|---|---|---|
| 6,652,428 | B2 * | 11/2003 | Meller et al. | 482/122 |
| 7,771,378 | B2 * | 8/2010 | Price et al. | 602/36 |
| 8,251,879 | B2 * | 8/2012 | Binns et al. | 482/112 |
| 2006/0041205 | A1 * | 2/2006 | Ladd, Jr. | 601/5 |
| 2009/0264799 | A1 * | 10/2009 | Bonutti et al. | 601/5 |
| 2012/0101419 | A1 * | 4/2012 | Bonutti et al. | 602/20 |

* cited by examiner

SHOULDER STRETCHER AND METHOD OF USE

CROSS REFERENCE TO RELATED APPLICATIONS

This application is a continuation-in-part application of and claims the benefit of International application PCT/US2008/066509, filed Jun. 11, 2008, and U.S. provisional application 60/949,480, filed Jul. 12, 2007, both of which are incorporated by reference herein.

FIELD OF INVENTION

The invention relates generally to a device for use in rehabilitation of the shoulder of a human, in particular to address tightness of the posterior capsule of the glenohumeral joint, i.e., the human shoulder.

BACKGROUND OF INVENTION

Tightness of the posterior capsule of the glenohumeral joint is a common problem that occurs secondary to a minor shoulder problem. It is a significant problem to athletes who throw, to post-operative patients having had shoulder surgery and to people who suffer from impingement syndrome of the shoulder, the most common source of shoulder pain.

Devices and methods for shoulder stretching are known. For example, U.S. Pat. No. 5,520,615 ("the '615 patent") describes a pulley system included in a self-assertive shoulder stretching and rotation machine wherein a supine person's forearm is secured to a forearm support that is attached to a horizontal support movable by the supine person's pulling on a rope. U.S. Pat. No. 6,007,500 ("the '500 patent") describes a belt and pulley system included in a rotator cuff stretching machine with pivoting members that provide for simultaneously stretching of the rotator cuff, shoulder and elbow in selective upper arm positions of yaw and pitch angles and selective elbow positions of flexion or extension. The '500 patent machine includes upper and forearm assemblies that are pivotably joined through a bearing assembly and requires the patient to sit upright. The assembly has a rotational capacity of 360 degrees and is attached to a vertical support that rotates in horizontal yaw on a vertical yaw pivot pin. U.S. Pat. No. 6,569,067 ("the '067 patent") describes a device that elevates the elbow off of the torso and abducts the arm for rehabilitating the shoulder. It includes a first C-shaped member for supporting the extremity of the patient and a second C-shaped member for engaging the torso of the patient.

SUMMARY OF INVENTION

Embodiments of a shoulder stretcher and methods of use described herein provide the first known devices that function to permit, without a physical therapist or other assistant, posterior capsular stretching of the human shoulder through use of a mechanical ratcheting device. In one preferred embodiment the device includes a base or rigid support, an arm strap, and a lever arm that is rotatably fastened to the base, and preferably includes a ratcheting mechanism that prevents reverse rotation except upon operation of a ratchet release. In another preferred embodiment the device includes a backboard, should strap, elbow cup with a pad, a hand grip and wrist stabilizer and a ratcheting mechanism.

The mechanical stretching device functions to stretch human shoulders and is preferably for use in shoulder rehabilitation and prevention of posterior capsular tightness and capsulitis. It can be used for self-stretching by a patient, and preferably incorporates a dial type ratcheting mechanism for staged stretching of the shoulder. It can be used for posterior capsule stretching and in its reverse position or orientation can be used for external rotation stretching. The shoulder stretching apparatuses and methods described herein function to provide for progressive stretching of the shoulder joint in both internal and external rotation. The apparatus provides a person with the capability to maximally stretch the shoulder without an assistant or therapist while slowly advancing range of motion in a desired plane. It allows the person to gradually advance the rotation of his or her shoulder capsule through a home therapy program. These functions and capabilities are accomplished by preferred strap systems that stabilize the arm and elbow to a firm platform while the forearm is progressively advanced in the desired direction of shoulder rotation by means of a lever arm. The ratcheting mechanism allows for forward stretching of the forearm without the ability to reverse or go backwards unless a release mechanism is activated. This provides the user with the ability to stretch his or her shoulder joint over an extended period and at his or her own pace. The device has the capability to rotate 180° and thus can be used for stretching either upper extremity, i.e., either the left or right shoulder. In addition to stretching the posterior capsule and internal rotation deficit, this device allows for dynamic sustained stretching in the external rotation plane. By simply releasing the ratcheting mechanism, the arm support can be rotated in either direction, thus allowing for a full 180° stretch.

During use of one embodiment in stretching, the injured shoulder's forearm is positioned adjacent to, or rested against the lever arm, and the user's/patient's forearm is strapped to or otherwise stabilized to the lever arm. The user's upper arm is strapped or otherwise stabilized to the base. In another preferred embodiment the user's shoulder is stabilized to the backboard and the user's wrist is stabilized to the ratchet mechanism lever arm. In both preferred embodiments the device's lever arm and the user's forearm are preferably advanced or rotated preferably by the patient's other arm. As the forearm of the injured shoulder is advanced, the ratchet mechanism clicks and holds its place with each advancing increment of rotation to prevent backward or reverse motion of the forearm. The patient can stop the rotation at any increment or increments of rotation to rest the shoulder at a desired degree or increment of rotation and stretching. After each rest period, the patient can then continue the sequence of rotation, rest; rotation, rest, etc., until a desired degree of stretching is reached for a given exercise or therapy session. During this sequential series of motions and rests the arm strap holds or stabilizes the patient's upper arm to the base or backboard, so that that shoulder does not lift off of the base or backboard. Thus, during use the arm strap or shoulder strap secures the patient's arm to the base or backboard in order to prevent the upper arm from lifting off of the base or backboard, as the forearm is advanced toward the base. Once the shoulder has been stretched adequately, or at any other time during the therapy session, a ratchet release actuator can be pressed or otherwise activated to release the ratchet. Releasing the ratchet mechanism permits reverse rotation, or backwards movement of the lever arm. The ratchet mechanism and lever arm preferably permit 180° of rotation of the lever arm/forearm rest. Thus, the device may be used for right and left shoulder rehabilitation, and for progressive, staged stretching of the shoulder at a pace and to the extent desired by the patient.

These and other embodiments, features, aspects, and advantages of the invention will become better understood with regard to the following description, appended claims and accompanying drawings.

BRIEF DESCRIPTION OF THE DRAWINGS

The foregoing aspects and the attendant advantages of the present invention will become more readily appreciated by reference to the following detailed description, when taken in conjunction with the accompanying drawings, wherein.

Figure 1:
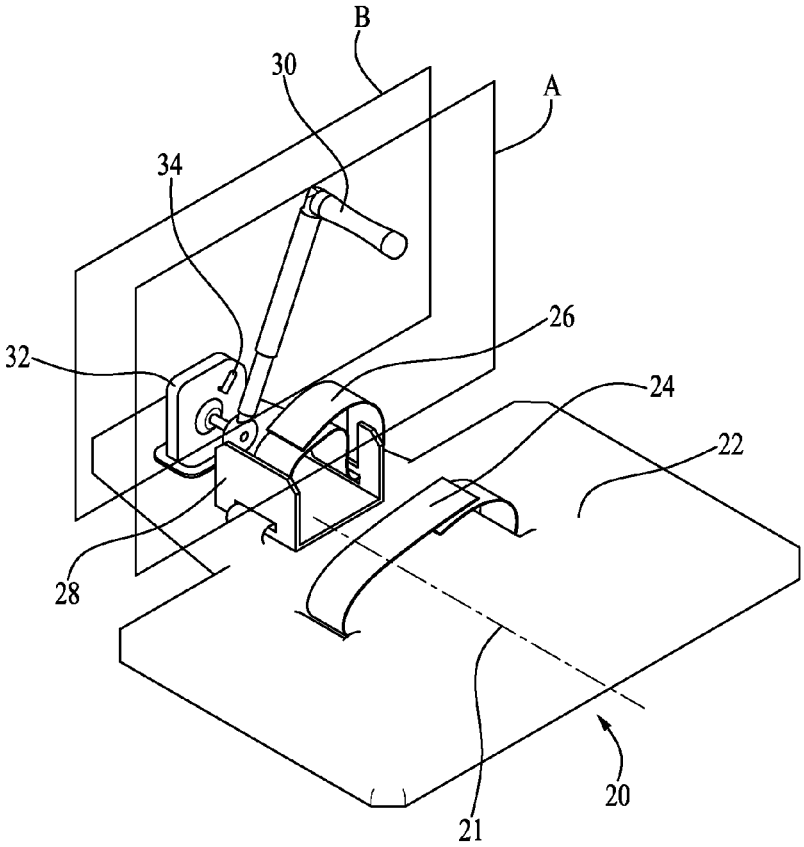
FIG. 1 is a perspective view of a preferred embodiment shoulder stretcher.
Figure 2:
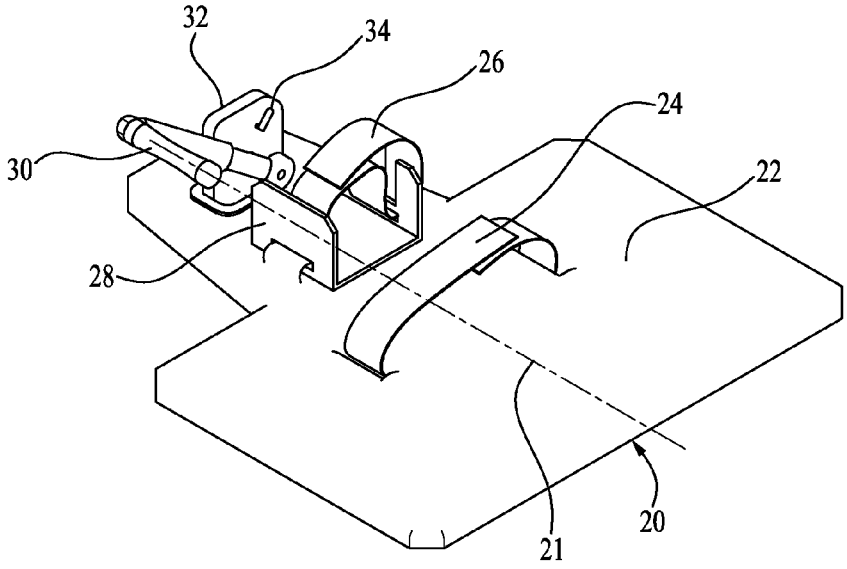
FIG. 2 is a perspective view of the FIG. 1 embodiment in reverse orientation.

Reference symbols or names are used in the Figures to indicate certain components, aspects or features shown therein. Reference symbols common to more than one Figure indicate like components, aspects or features shown therein.

DETAILED DESCRIPTION

With reference to FIGS. 1-26 preferred embodiments of the mechanical shoulder stretcher device and methods of their use will be described. Referring to FIGS. 1-8, a first preferred embodiment shoulder stretcher 20 includes a base or rigid support 22, arm strap 24, elbow strap 26, lever arm 30, ratchet mechanism 32 and ratchet release actuator 34. Shoulder stretcher 20 functions to stretch the posterior capsule without need for a physical therapist or other assistant. The device has the capability to rotate 180° and thus can be used for stretching either upper extremity, i.e., either the left or right shoulder. In addition to stretching the posterior capsule and internal rotation deficit, this embodiment allows for dynamic sustained stretching in the external rotation plane. By simply releasing the ratcheting mechanism, the arm support can be rotated in either direction, thus allowing for a full 180° stretch. In other words, the person with the injured shoulder, i.e., the patient, can operate the device by himself or herself. The attendant advantages to such a self-use device include more flexibility in scheduling therapy sessions, reduced costs, and increased number of therapy sessions because no appointment with a physical therapist is needed. The shoulder stretcher 20 is intended to be used for shoulder rehabilitation and prevention of posterior capsular tightness or capsulitis, i.e., inflammation of the shoulder capsule.

Base 22 is preferably a padded board and functions to provide a stable platform for the user's torso. The board need not be padded. While the board shown in the FIG. 1 embodiment is generally rectangular, having a longitudinal centerline 21, it may be of virtually any shape, and be made of virtually any material so long as it provides a platform sufficiently stable to facilitate stretching of the shoulder in accordance with the methods of stretching described herein. Also, the size of the board may vary, in accordance with the size of the user, i.e., a relatively small board for a small user such as a child, and a relatively large board for a larger user, such as a professional basketball, football or baseball player.

The arm strap or belt 24 is preferably a conventional strap that may be made of leather, natural fibers or synthetic material. The arm strap 24 preferably extends from two slots in the base that are preferably equidistant from the centerline 21 and functions to provide a firm, stable securing of the patient's upper arm to the base 22 with sufficient restraining force to prevent the upper arm from lifting off of the patient's proximal shoulder during use of the device. By the term upper arm is meant that part of the arm surrounding the humerus bone. Preferably a single strap is used, and the strap is of a sufficient width and placed in a position on the base so that during use it functions to hold the upper arm, from the distal end of the humerus bone to the proximal end of the humerus bone in a fixed position on or near to the base. Preferably the arm strap and the slots are constructed and adapted to be capable of movement long the centerline 21 to accommodate arms of different lengths. This allows for variations in size of the patients' arm length between the elbow and the shoulder. During use it is important that this strap be tightened enough to hold down the shoulder/upper arm so that the shoulder touches the base during use of the device, or alternatively, holds the shoulder/upper arm close to the base during use of the device. When the patient's arm is stretched in this device, it has a tendency to rise superiorly, and thus the arm strap functions to prevent this rise. As will be apparent to those skilled in this art, one or more arm straps may be used. Also, various materials of construction may be used, such as for example, leather, natural fiber cloth, and synthetic materials.

Figure 3:
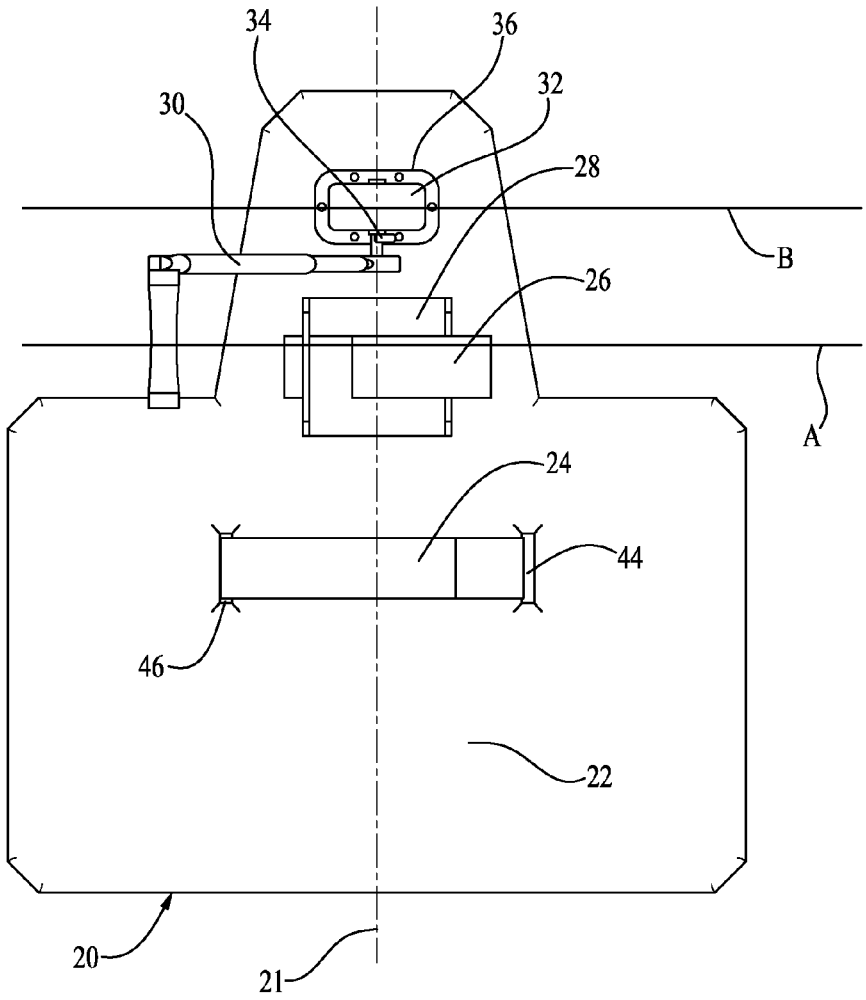
FIG. 3 is a top view of the stretcher as shown in FIG. 2.

The arm strap preferably has Velcro® brand or some other brand of loop and hook type fastener to maintain the strap in a tightened position. Alternatively, other conventional belt-fastening devices may be used. The arm strap 24 may be made of virtually any material and may be fastened in a tight position with virtually any type of fastener, including a conventional knot, so long as the strap is capable of functioning for its intended purpose. Optionally, the device may be made to have the arm strap positionable at various locations along centerline 21, as shown in FIG. 3. Such a construction is believed to be within the skill of a person of ordinary skill in this field, and could include, optionally, for example relatively long slots 44, 46 that would extend in the same direction as line 21, but of course be longer than the slots 44, 46 illustrated in FIG. 3. Use of such a positionable arm strap would of course enable a single device to be used by patients of a wide range of sizes.

As shown in FIGS. 1-5 and 7-8, a second strap 26 also provides for holding the upper arm down on or near to the base during operation. As shown here the second strap 26 operates primarily on the distal end of the upper arm for the injured shoulder. Second arm strap 26 is preferably a conventional strap, much like the first arm strap 24, and is used to secure the elbow and lower part of the upper arm to the base during use. In one embodiment the second arm strap 26 is preferably provided with a reinforcing frame 28 having opposed sides that are equidistant from the centerline 21, and that function to provide additional structure to secure the patient's elbow to the base so that the elbow does not lift off the base during use. As described above, use of two arm straps is optional. In one embodiment, a single arm strap may be used so long as it functions to restrain movement of the shoulder away from the base during operation of the device.

Figure 4:
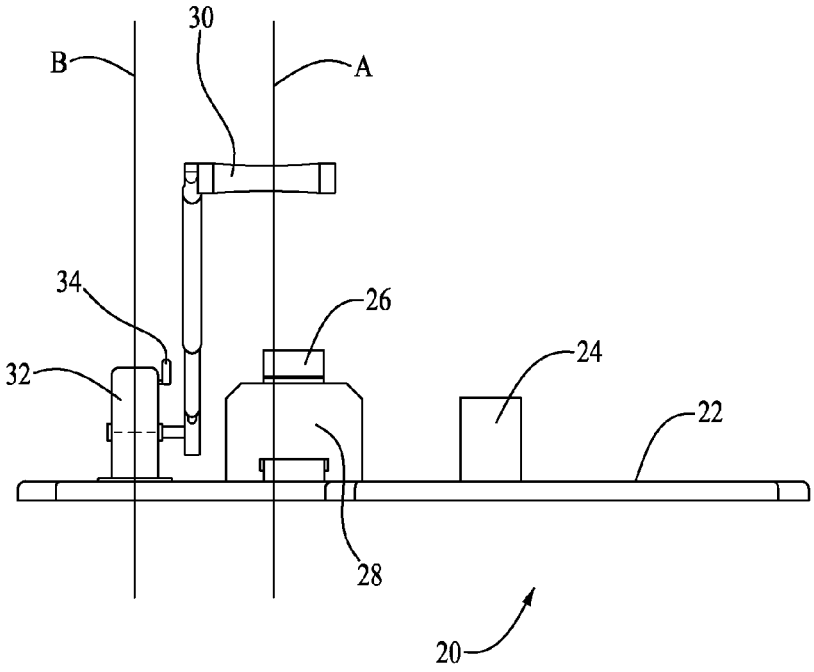
FIG. 4 is a front view of the stretcher as shown in FIG. 2.
Figure 5:
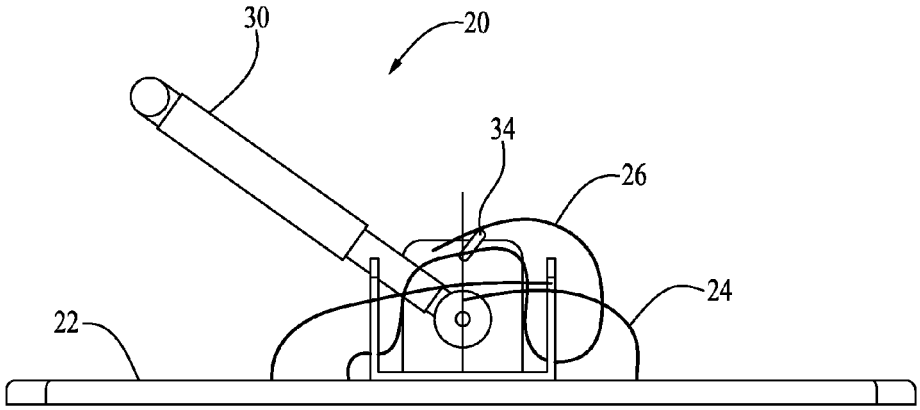
FIG. 5 is a side view of the stretcher as shown in FIG. 2.
Figure 6:
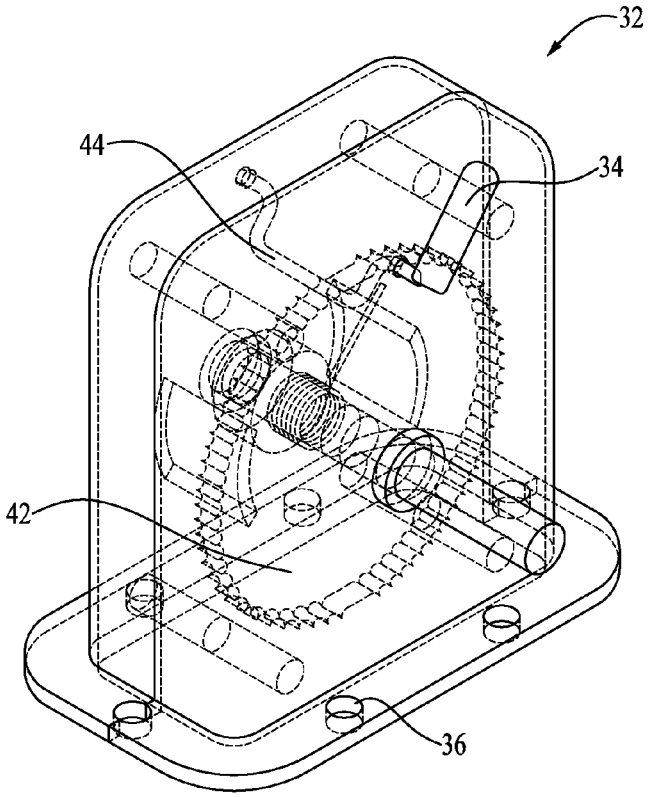
FIG. 6 is a view of the ratchet mechanism of the FIG. 1 embodiment with the housing shown in dashed lines to expose the interior ratchet mechanism.
Figure 7:
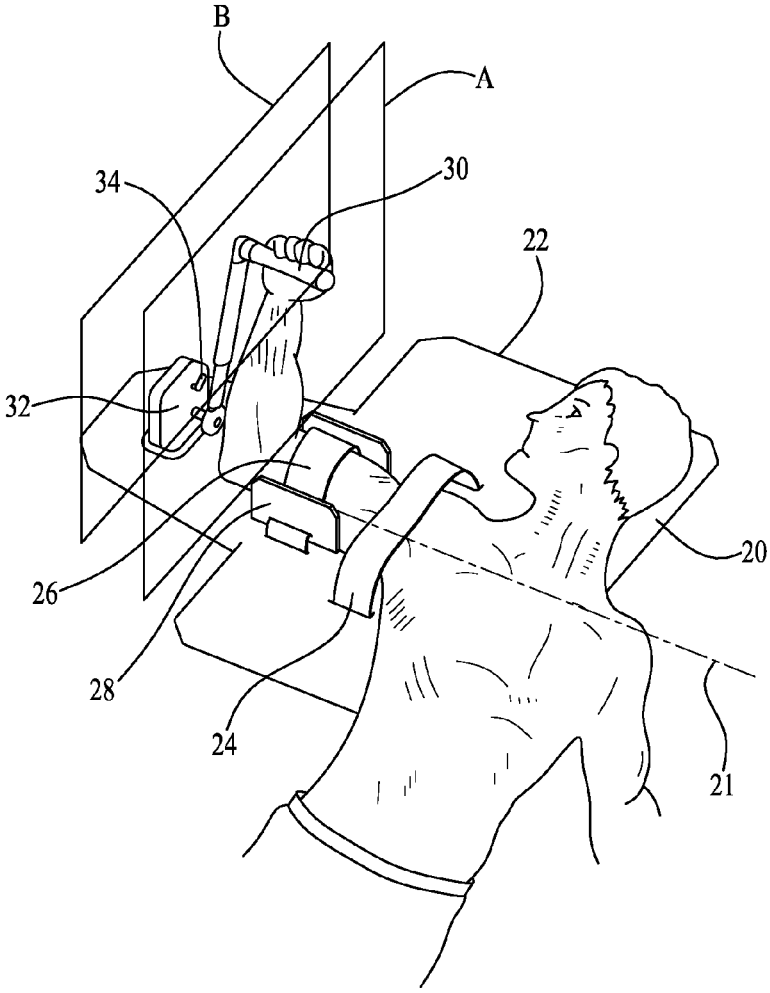
FIG. 7 is a view of the FIG. 1 embodiment including a drawing of a user as would be orientated during a shoulder stretching operation; and, FIG. 8 is a view of an alternate embodiment showing a lever arm that includes a forearm rest.
Figure 8:
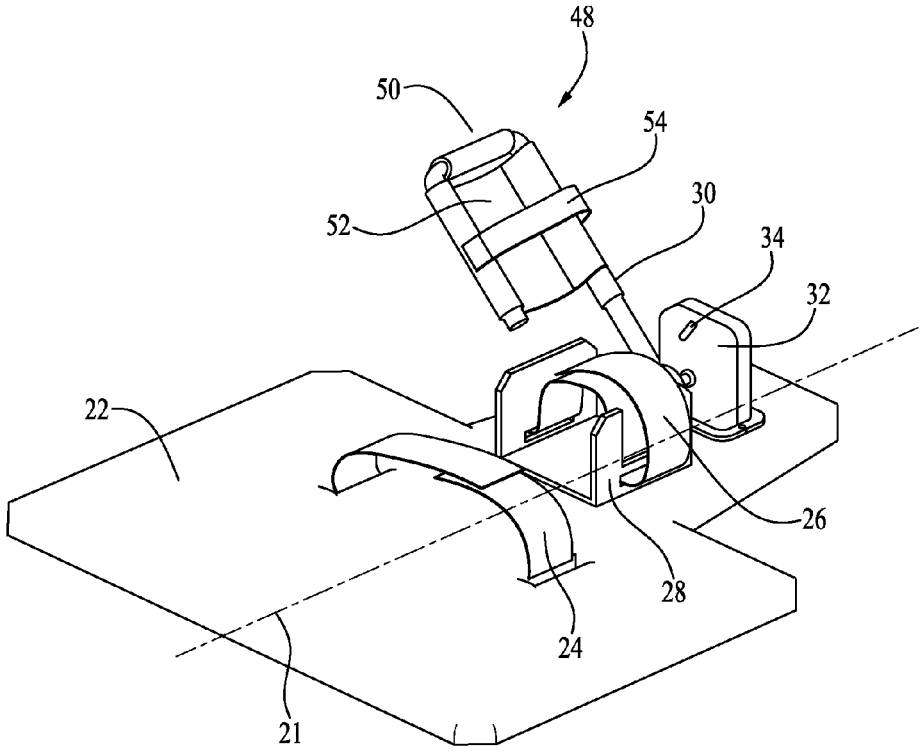
Figure 10:
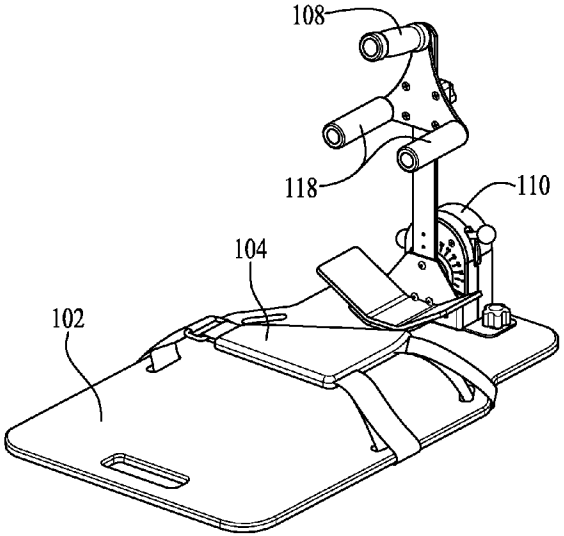
FIG. 10 is a perspective view of the FIG. 9 embodiment shown from a different angle.
Figure 9:
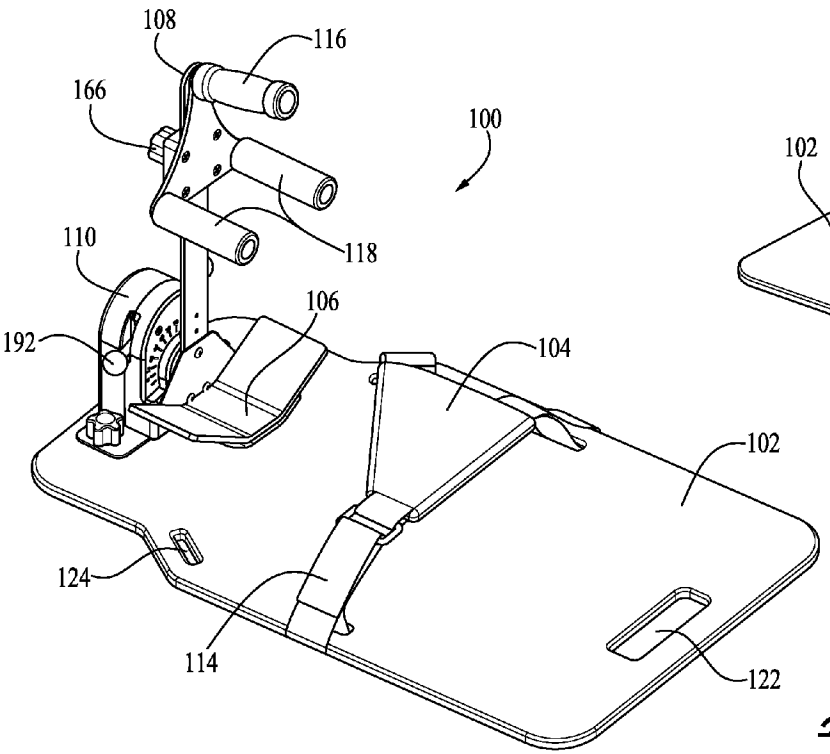
FIG. 9 is a perspective view of a preferred alternate embodiment showing a shoulder strap and a wrist stabilizer.

Telescoping lever arm 30 includes at one end a handle and at its other end a connection to the axle of ratchet mechanism 32. The axle extends along the centerline 21, at a relatively short distance above the centerline 21, and provides an axis of rotation for the ratchet mechanism 32 and lever arm through planes that are perpendicular to the axis of rotation. In FIGS. 1, 3 and 4 a plane through which the lever arm rotates is shown as plane A, and the plane through which the ratchet wheel or gear rotates is shown as plane B. Planes A and B are generally perpendicular to the plane in which the base 22 lies and they are also generally perpendicular to the axis of rotation of the ratchet mechanism. As may be appreciated, the plane in which the ratchet mechanism rotates, plane B, is parallel to the plane in which the lever arm rotates, i.e., plane A. The conventional telescoping arm provides for and accommodates a range of arm lengths. The handle extends back toward the patient and during use of the device may be gripped by the patient's hand or used as a support for the patient's hand, either front side or back side. With reference to FIGS. 6 and 8, the ratchet mechanism includes a gear or toothed wheel positioned inside of a housing and fastened about the axle for rotation in either the clockwise direction or counterclockwise direction. A U-shaped brake 44 is rotatingly attached to one side of the housing, and extends exterior to the housing in the form of a release and reverse lever 34. As shown in FIG. 6, the lever 34 operates as a brake against rotation in a clockwise direction. By rotating the lever 34 in a clockwise direction the brake 44 is also rotated clockwise to a position against the wheel 42 at which it operates as a brake against counterclockwise direction. The housing is fastened to the base via conventional fasteners 36, such as screws, rivets, staples, nails, glue or any other means so long as they function to keep the housing fastened to the base. FIG. 7 illustrates the positioning of a user's body, particularly the shoulder, upper arm, forearm and hand in relation to the various parts of the shoulder stretcher mechanism.

As shown in FIG. 8, the device may be provided with an optional forearm rest 48 positioned on the lever arm 30. The forearm rest functions to provide a stable support for the forearm. The end of the lever arm 30 distal from the ratchet mechanism 32 is formed into a "U" shape, with the closed end of the "U" forming a handgrip 50. The handgrip may be made of any of a variety of materials, such as cloth, a rubber or elastomeric material, or an absorbent material. A sling 52 is positioned on the legs of the "U" and extends between the "U" to form and function as a forearm rest. A strap 54 is preferably fastened to one of the legs of the "U" and extends across, and is attachable at the opposite let of the "U". The strap 54 functions to provide a restraint for the forearm in one direction of rotation, and as the forearm rest in the opposite direction of rotation. The strap 54 is preferably fastened to one leg with a hook and loop type fastener. Various types of materials may be used for, and various techniques may be used to fasten the forearm sling and forearm strap to the lever arm 30. In yet another alternate embodiment, the lever arm may be in the form of a horseshoe with elongated legs of the same length, the distal ends of which are fastened to the axle of the ratchet mechanism. In this alternate embodiment webbing, a solid surface or some other material extends between the elongated legs and then along the length of the lever arm to function as a forearm rest or support. The elongated horseshoe lever arm may also be of a telescoping design capable of adjustment to accommodate arms of different length.

Figure 11:
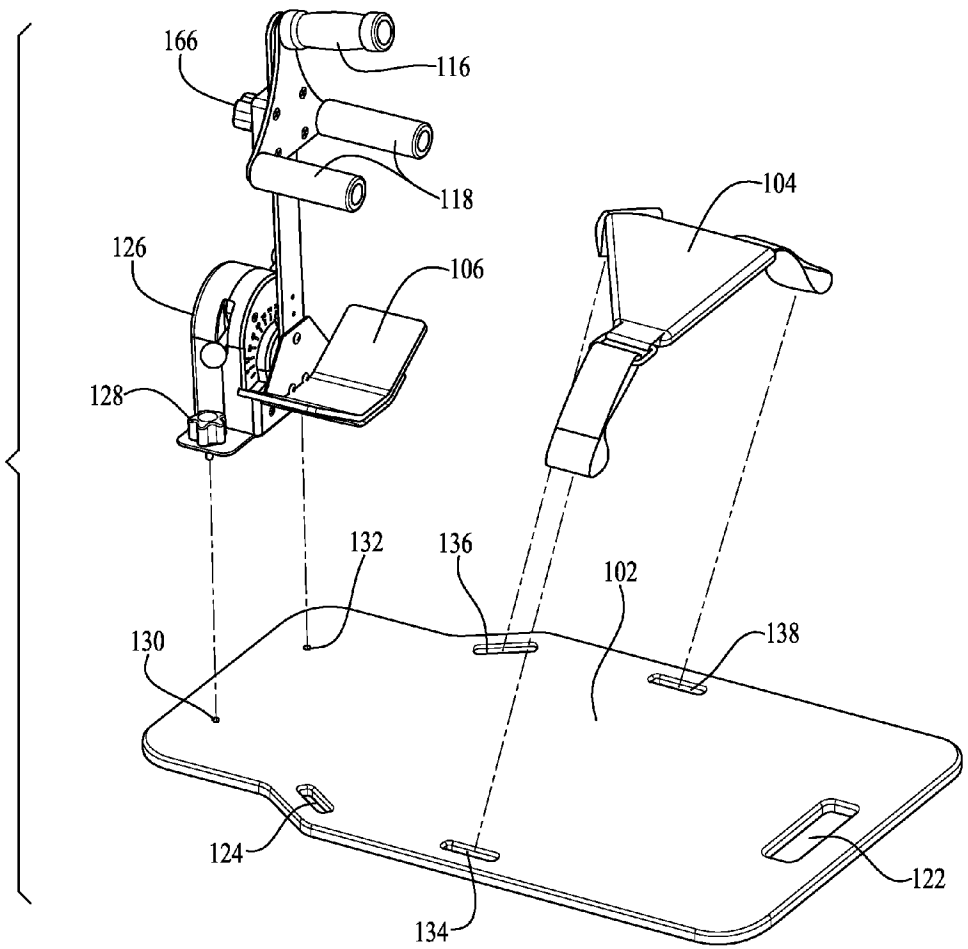
FIG. 11 is an exploded perspective view of the FIG. 9 embodiment.

Referring to FIGS. 9-26, a second preferred embodiment shoulder stretcher 100 includes a backboard 102, shoulder strap 104, elbow cup with pad 106, lever arm 108, ratchet mechanism 110 and ratchet direction lever 192. Shoulder strap 104 is shown as a generally triangular shaped strap, and can be of various shapes and sizes so long as it functions to restrain the patient's shoulder during use. Shoulder strap 104 is attached to backboard 102 at three locations, one of which is adjustable, shown as a Velcro brand fastener and adjustable strap at 114. The adjustment capability may be accomplished through various types, sizes and locations of components, so long as they cooperate to provide for adjustment to accommodate variously sized shoulders. Positioned at one end of the lever arm 108 are a handgrip 116 and a wrist stabilizer 118. The lever arm 108 also includes a handle adjustment knob 166. The backboard may also have additional slots, such as at 122 and 124 to provide locations for additional/alternate straps with which to stabilize the shoulder to the backboard and/or the backboard to some other structure. As shown in FIG. 11, an exploded view of FIGS. 9-1, the arm assembly 126 is shown with attachment knobs, one of which is shown at 128, positioned to removably attach the arm to the backboard 102 with their pins extending through attachment holes 130, 132 on the backboard 102. Also shown in FIG. 11 are shoulder strap holes 124, 134, 136 and 138.

Figure 12:
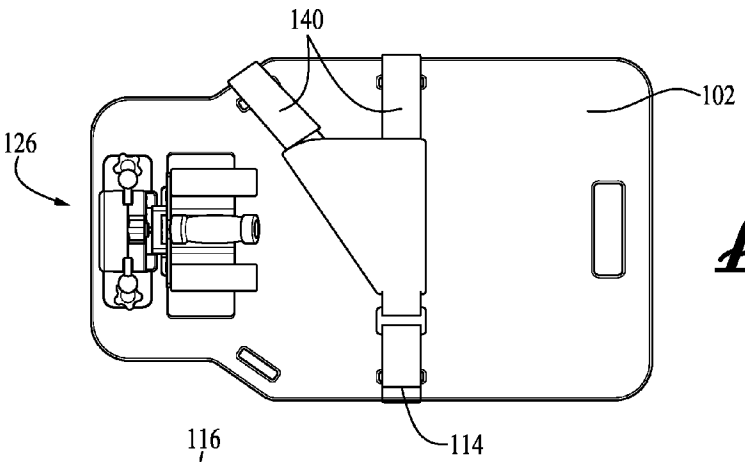
FIG. 12 is a top view of the FIG. 9 embodiment.
Figure 14:
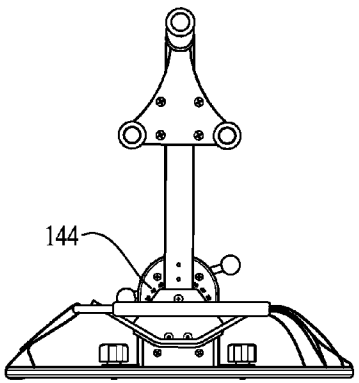
FIG. 14 is a side view of the FIG. 9 embodiment.
Figure 13:
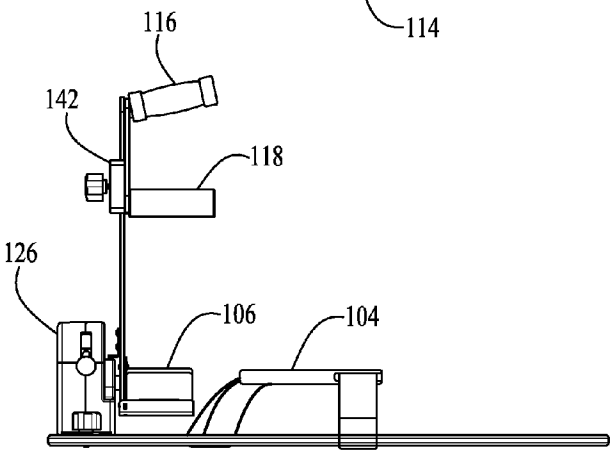
FIG. 13 is a front view of the FIG. 9 embodiment.

Referring to FIGS. 12-14, the shoulder strap 104 includes removable strap anchors 140 and the Velcro brand fastener for the adjustable strap 114. A side view of the hand grip assembly 142 and ratchet arm assembly 126 is provided in FIG. 13. The opposite side view shown in FIG. 14 illustrates the location of numeric indicator 144.

Figure 15:
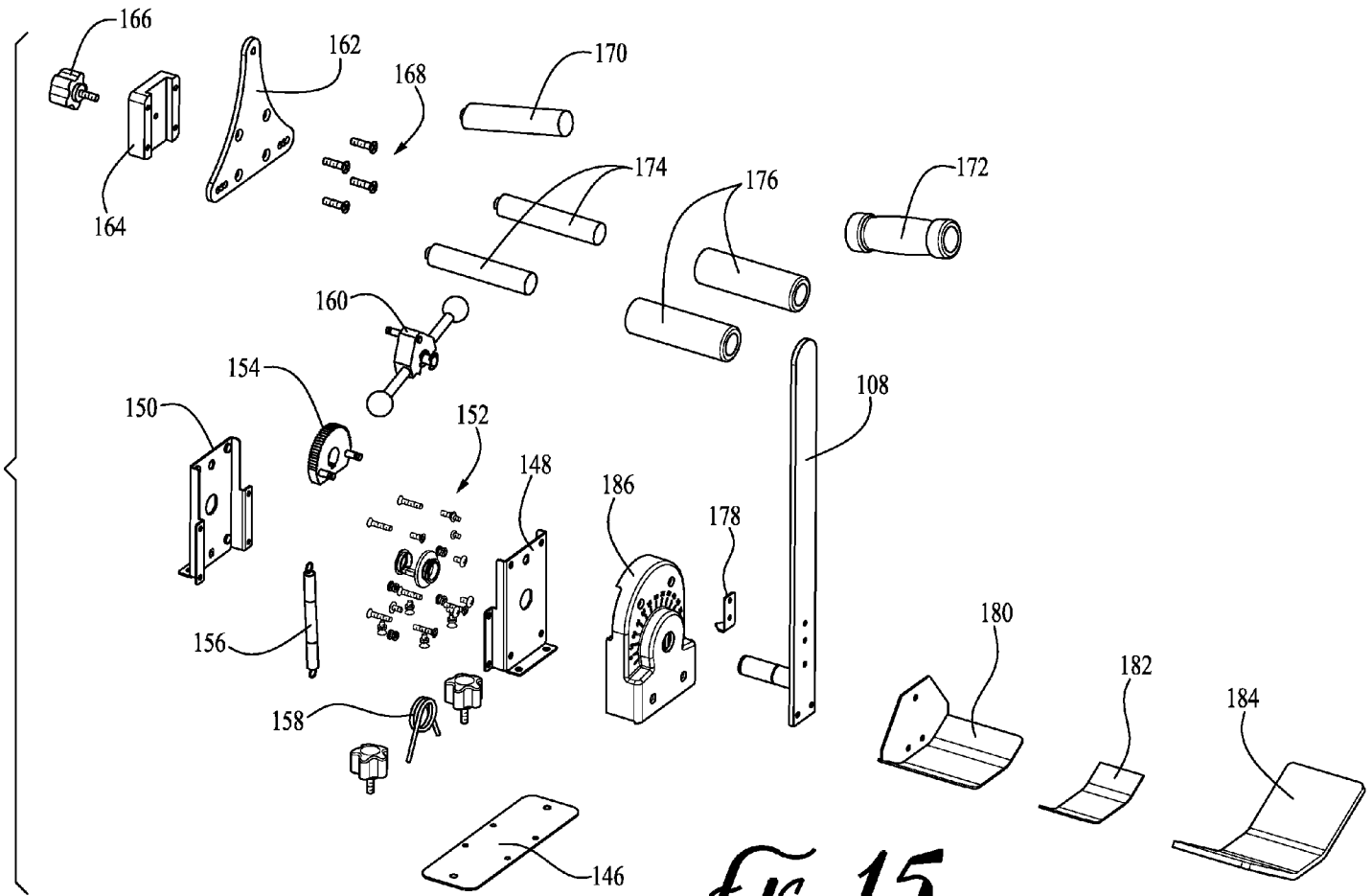
FIG. 15 is an exploded perspective view of the arm assembly and handle assembly of the FIG. 9 embodiment.

Referring to FIG. 15, an exploded view of the ratchet assembly 126 and hand grip assembly 142, the components of those assemblies will be described. Ratchet assembly 126 is fastened to mounting plate 146 via screws not shown and the mounting plate is attached to the backboard with two attachment knobs 128. Ratchet assembly 126 includes a first chassis member 148 and a second chassis member 150 fastened together with a plurality of screws shown at 152, but not specifically numbered. The ratchet mechanism is preferably conventional and includes ratchet gear 154, over center spring 156, balance spring 158, ratchet pawl 160 and fasteners also shown generally at 152, but not specifically numbered. Hand grip assembly 142 includes lever arm 108, handle back plate 162, handle clamp plate 164, handle adjustment knob 166, a plurality of screw fasteners shown at 168, handle bar 170 and hand grip 172 forming handgrip 116, wrist bars 174 and wrist pads 176 forming wrist stabilizer 118. Attached to the arm 108 is angle indicator 178 to display the angle of rotation of the arm during use. Also attached to the arm 108 are elbow cup 180, Velcro brand attachment strip 182 and elbow pad 184, which when assembled provide padding and support for the patient's elbow. Handle clamp plate 164 is slideably, adjustably fastened to back plate 162 via the adjustment knob 166. The hand grip and wrist stabilizer are fastened to the handle back plate 162 on the side opposite the handle adjustment knob. The ratchet assembly is enclosed in an enclosure, one side of which is shown at 186.

Figure 16:
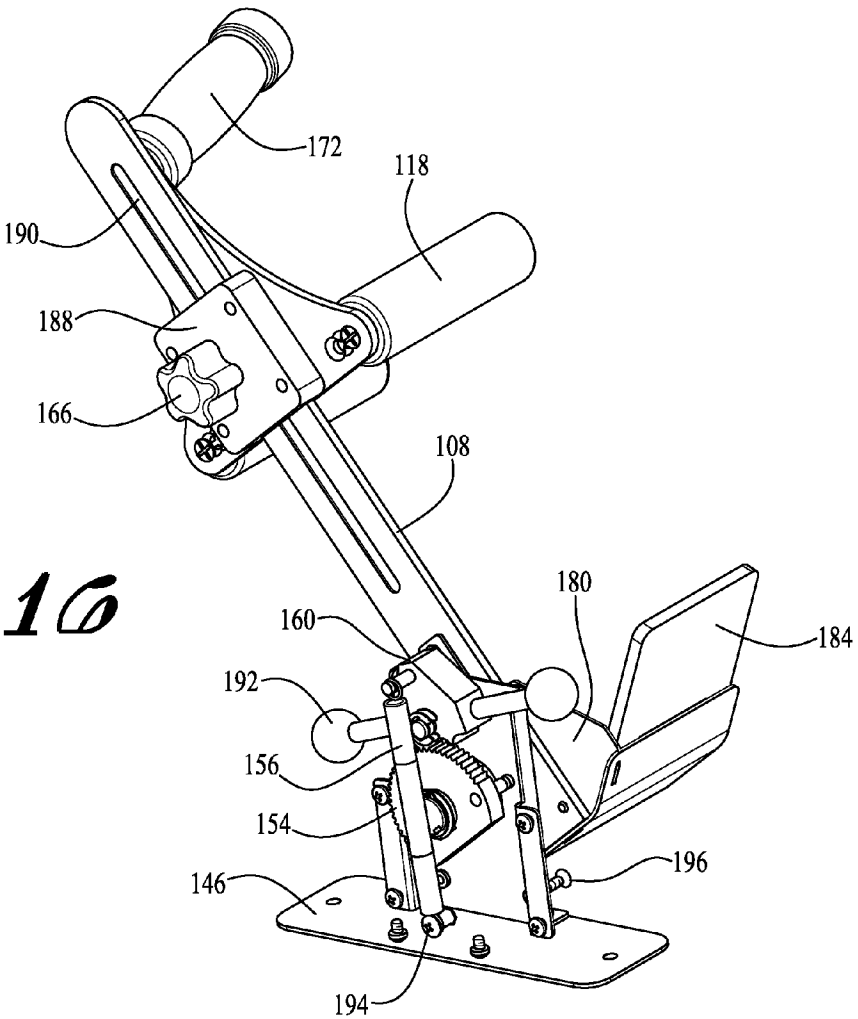
FIG. 16 is a close-up perspective view of arm assembly and ratchet assembly of the FIG. 9 embodiment.
Figure 17:
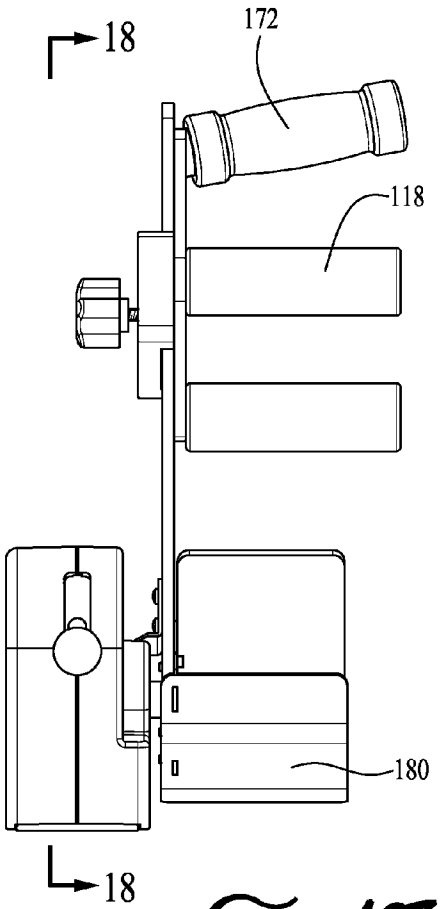
FIG. 17 is a close-up side view of arm and ratchet assemblies of the FIG. 9 embodiment shown in a first position.
Figure 18:
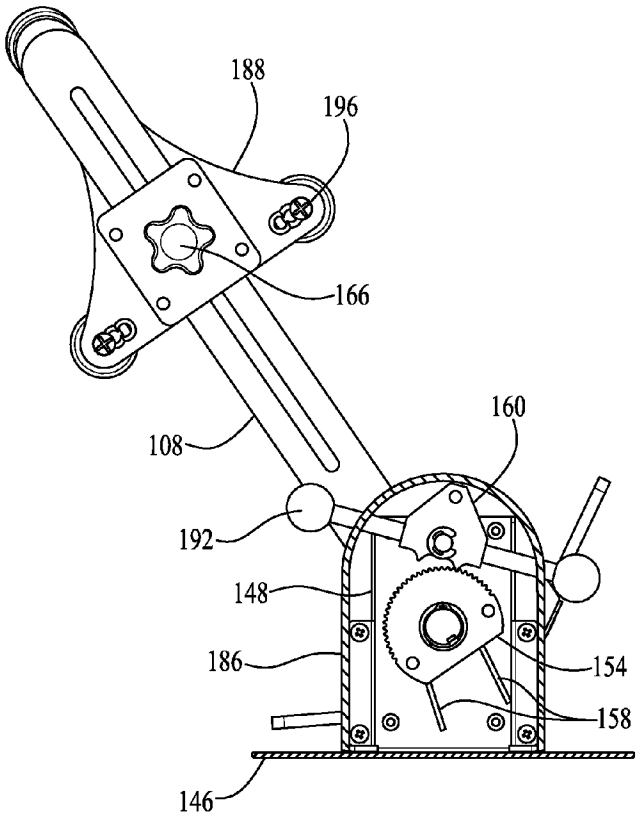
FIG. 18 is a close-up front view of arm and ratchet assemblies of the FIG. 9 embodiment taken through line B-B of FIG. 17.

Referring to FIGS. 16-18 further description and options for construction of the lever arm assembly and ratchet assembly are provided. The lever arm assembly includes handle assembly 188, handle adjustment knob 166 so that it is slidably positioned along the length of the arm 108 by loosening knob 166, moving the handle assembly along the slot 190 and tightening the knob 166 at a position depending on the length of the arm of the user. Hand grip 172 and wrist stop 118 are shown positioned on the arm 108 on the side opposite that of the knob 166. Handgrip 172 may be positioned so that it extends at 90° from the arm 108, or, preferably at some other angle, such as shown in FIGS. 16-17, for comfort and effectiveness during use by a patient. Elbow cup 180 and elbow pad 184 are also shown at the bottom of arm 108. The ratchet assemble is attached to the arm 108 on the other side of the elbow cup 180 and elbow pad 184. The ratchet assembly is shown assembled, and includes ratchet gear 154 as it is positioned in the enclosure, but in FIG. 16 the enclosure is not shown. One of the set screws for the enclosure is shown at 196 for ease in viewing the relative positioning of the ratchet mechanism components. Positioned above the gear 154 is direction lever 192 and ratchet pawl 160. Over center tension spring 156 is shown anchored to the pawl at its top and anchored to the mounting plate 146 by stationary spring anchor 194.

FIGS. 17 and 18 provide additional details regarding the orientation of various components, each to the other, so as to facilitate understanding of operation. Handle assembly preferably also includes wrist stop adjustments, including screw 196 and a slot, or series of overlapping holes through which the screw may be positioned and then tightened to adjust the position of each wrist stop. FIG. 18 also illustrates details of the ratchet pawl 160 and direction lever 192, by showing its engagement with the ratchet gear 154. Balance spring 158 is also shown in position to act as a force to balance the gear and return it to a neutral position when the pawl is not engaged. In these views the interior components are shown as positioned within chassis 148 and enclosure 186.

Figure 19:
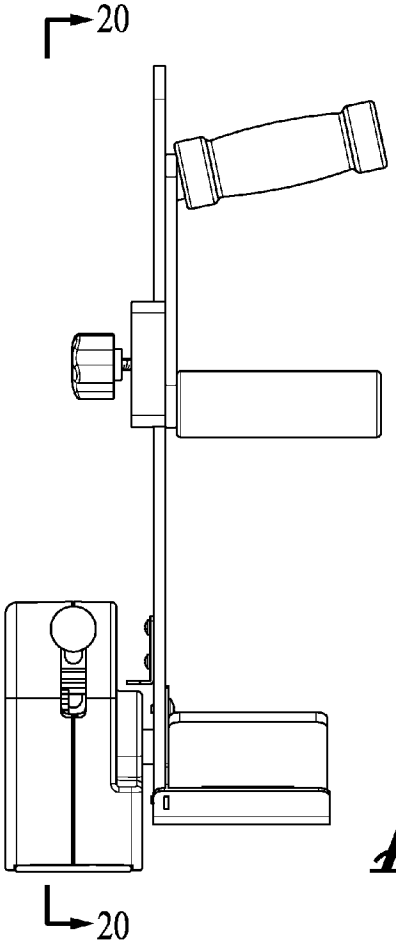
FIG. 19 is a close-up side view of arm and ratchet assemblies of the FIG. 9 embodiment shown in a second position.
Figure 20:
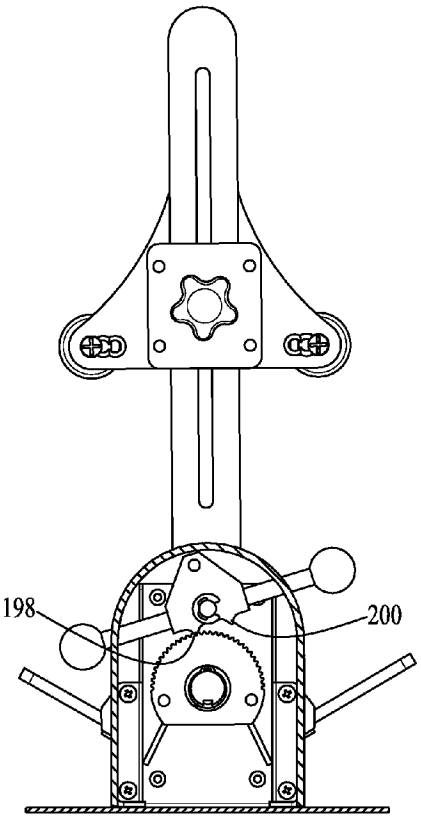
FIG. 20 is a close-up front view of arm and ratchet assemblies of the FIG. 9 embodiment taken through line B-B of FIG. 19.
Figure 21:
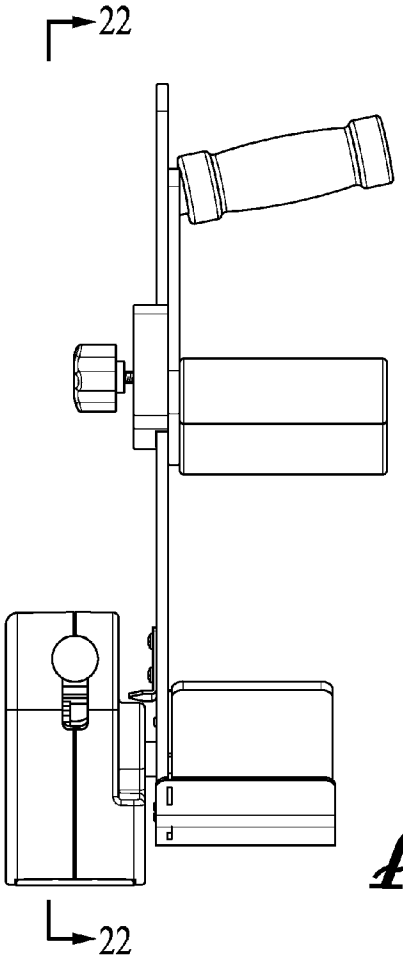
FIG. 21 is a close-up side view of arm and ratchet assemblies of the FIG. 9 embodiment shown in a third position.
Figure 22:
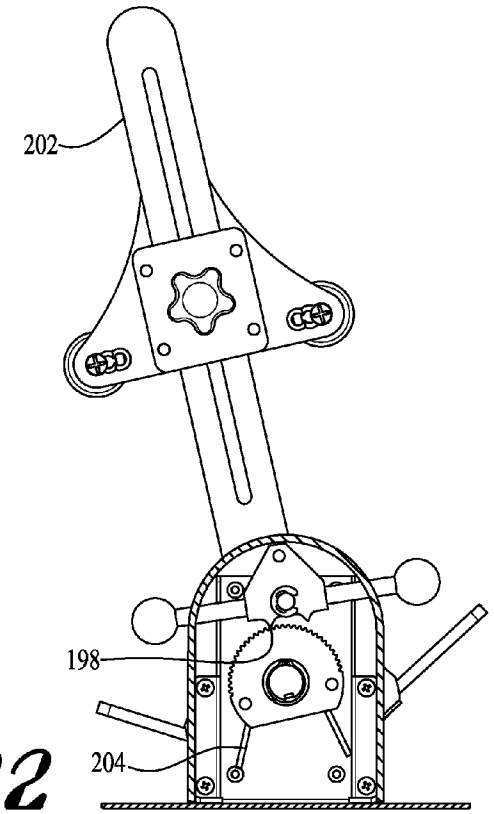
FIG. 22 is a close-up front view of arm and ratchet assemblies of the FIG. 9 embodiment taken through line B-B of FIG. 21.
Figure 23:
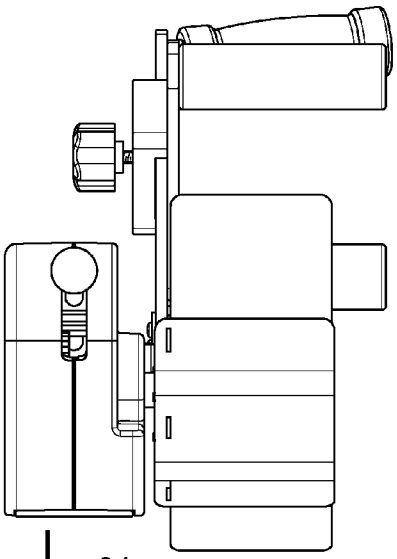
FIG. 23 is a close-up side view of arm and ratchet assemblies of the FIG. 9 embodiment shown in a fourth position.
Figure 24:
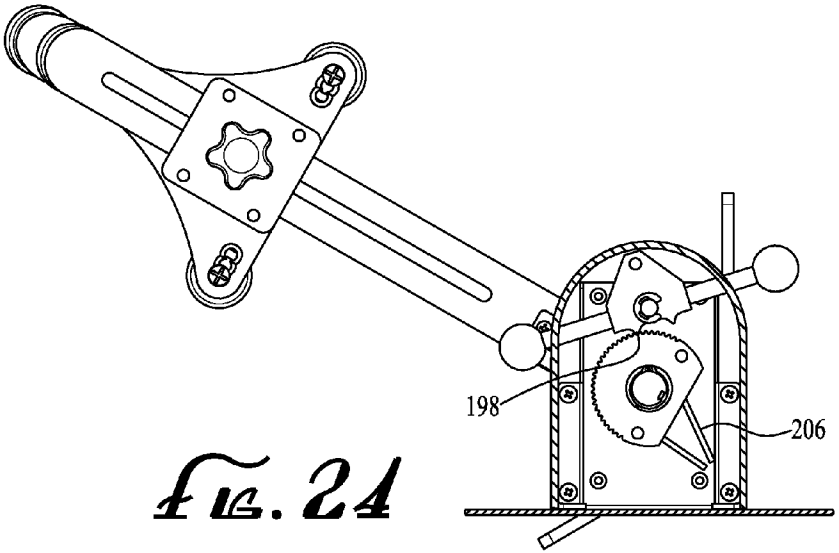
FIG. 24 is a close-up front view of arm and ratchet assemblies of the FIG. 9 embodiment taken through line B-B of FIG. 23.

FIGS. 19 and 20 show the arm 108 in a vertical position and first detent 198 engaged and second detent 200 disengaged from the gear 154. In FIGS. 21 and 22 the arm 108 is shown at position 202 to indicate that is a point during movement in a counterclockwise direction. Detent 198 remains engaged with the gear 154 to illustrate that as the arm rotates the ratchet clicks over detent 198, and the balance spring 158 is compressing as shown at 204. FIGS. 23-24 show the positions of the arm and ratchet components as the arm has been rotated further in a counterclockwise direction. Detent 198 remains engaged with the gear 154, but in a radial position that is different than that shown in FIGS. 19-22. Balance spring 158 has been compressed further as shown at 206.

Figure 25:
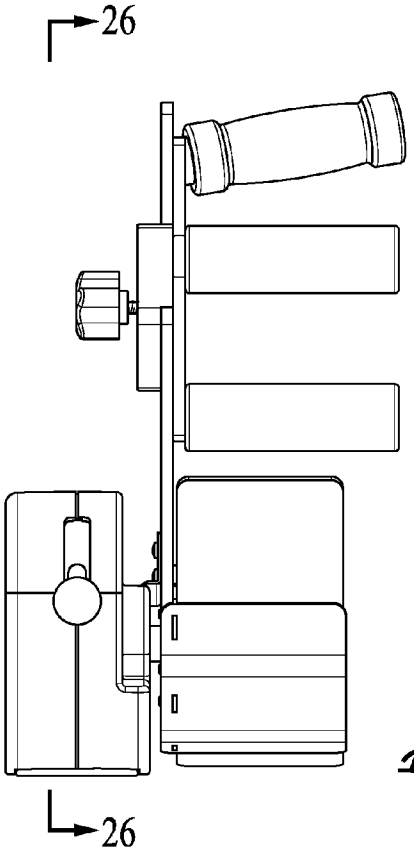
FIG. 25 is a close-up side view of arm and ratchet assemblies of the FIG. 9 embodiment shown in a fifth position.
Figure 26:
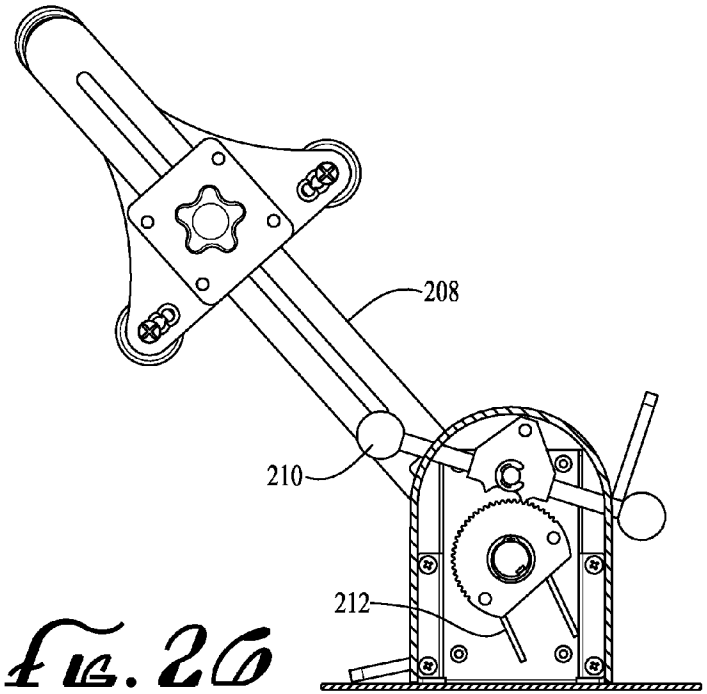
FIG. 26 is a close-up front view of arm and ratchet assemblies of the FIG. 9 embodiment taken through line B-B of FIG. 25.

In FIGS. 25-26 the arm and ratchet mechanism are shown when the arm 108 has moved in a clockwise direction from the position shown in FIGS. 23-24 to a new, different position shown at 208. The ratchet handle or direction lever 192 has been reversed, as shown at 210. In this position the second detent 200 is engaged and clicking whereas the first detent 198 is disengaged from the gear. Also, the balance spring 158 has been unloading as the arm moves in a clockwise direction from the position shown in FIGS. 23-24, and is shown in a relatively unloaded condition at 212. The above description of motion of the arm from a vertical position counterclockwise to the extended position shown in FIGS. 23-24 also applies to motion of the arm from vertical in a clockwise direction, with corresponding engagement and disengagement of the opposite detents, and compression and unloading of the springs taking place on opposite sides of the ratchet mechanism.

The shoulder stretcher embodiments described herein function to stretch the posterior capsule without need for a physical therapist or other assistant. The devices have the capability to rotate 180° and thus can be used for stretching either upper extremity, i.e., either the left or right shoulder. In addition to stretching the posterior capsule and internal rotation deficit, these embodiments allow for dynamic sustained stretching in the external rotation plane. By simply releasing the ratcheting mechanism, the arm support can be rotated in either direction, thus allowing for a full 180° stretch. In other words, the person with the injured shoulder, i.e., the patient, can operate the device by himself or herself. The attendant advantages to such self-use devices include more flexibility in scheduling therapy sessions, reduced costs, and increased number of therapy sessions because no appointment with a physical therapist is needed. The shoulder stretchers described herein are intended to be used for shoulder rehabilitation and prevention of posterior capsular tightness or capsulitis, i.e., inflammation of the shoulder capsule.

The base or backboard is preferably a padded board and functions to provide a stable platform for the user's torso. The board need not be padded. While the preferred board or base is generally rectangular, having a longitudinal centerline, it may be of virtually any shape, and be made of virtually any material so long as it provides a platform sufficiently stable to facilitate stretching of the shoulder in accordance with the methods of stretching described herein. Also, the size of the board may vary, in accordance with the size of the user, i.e., a relatively small board for a small user such as a child, and a relatively large board for a larger user, such as a professional basketball, football or baseball player.

The straps or belts are preferably made of conventional materials such as leather, natural fibers or synthetic material. The first embodiment arm strap 24 preferably extends from two slots in the base that are preferably equidistant from the centerline 21 and functions to provide a firm, stable securing of the patient's upper arm to the base 22 with sufficient restraining force to prevent the upper arm from lifting off of the patient's proximal shoulder during use of the device. By the term upper arm is meant that part of the arm surrounding the humerus bone. In this embodiment preferably a single strap is used, and the strap is of a sufficient width and placed in a position on the base so that during use it functions to hold the upper arm, from the distal end of the humerus bone to the proximal end of the humerus bone in a fixed position on or near to the base. Preferably the arm strap and the slots are constructed and adapted to be capable of movement long the centerline 21 to accommodate arms of different lengths. This allows for variations in size of the patients' arm length between the elbow and the shoulder. During use it is important that this strap be tightened enough to hold down the shoulder/upper arm so that the shoulder touches the base during use of the device, or alternatively, holds the shoulder/upper arm close to the base during use of the device. When patient's the arm is stretched in this device, it has a tendency to rise superiorly, and thus the arm strap functions to prevent this rise. As will be apparent to those skilled in this art, one or more arm straps may be used. Also, as shown in the alternated preferred embodiment, the shape and size and position may be varies such that it functions and may be referred to as a shoulder strap. Here, as with other embodiments, various materials of construction may be used, such as for example, leather, natural fiber cloth, and synthetic materials.

The straps preferably have Velcro® brand or some other brand of loop and hook type fastener to maintain the strap(s) in a tightened position. Alternatively, other conventional belt-fastening devices may be used. The straps may be made of virtually any material and may be fastened in a tight position with virtually any type of fastener, including a conventional knot, so long as the straps are capable of functioning for their intended purpose. Optionally, the devices may be made to have the straps positionable at various locations on the base or backboard. Such alternate constructions are believed to be within the skill of a person of ordinary skill in this field, and could include, optionally, for example relatively long slots and differently shaped slots. Use of such positionable straps would of course enable a single device to be used by patients of a wide range of sizes.

Also in regard to the first embodiment, as shown in FIGS. 1-5 and 7-8, a second strap 26 also provides for holding the upper arm down on or near to the base during operation. As shown here the second strap 26 operates primarily on the distal end of the upper arm for the injured shoulder. Second arm strap 26 is preferably a conventional strap, much like the first arm strap 24, and is used to secure the elbow and lower part of the upper arm to the base during use. In one embodiment the second arm strap 26 is preferably provided with a reinforcing frame 28 having opposed sides that are equidistant from the centerline 21, and that function to provide additional structure to secure the patient's elbow to the base so that the elbow does not lift off the base during use. As described above, use of two arm straps is optional. In one embodiment, a single arm strap may be used so long as it functions to restrain movement of the shoulder away from the base during operation of the device.

Telescoping lever arm 30 includes at one end a handle and at its other end a connection to the axle of ratchet mechanism 32. The axle extends along the centerline 21, at a relatively short distance above the centerline 21, and provides an axis of rotation for the ratchet mechanism 32 and lever arm through planes that are perpendicular to the axis of rotation. In FIGS. 1, 3 and 4 a plane through which the lever arm rotates is shown as plane A, and the plane through which the ratchet wheel or gear rotates is shown as plane B. Planes A and B are generally perpendicular to the plane in which the base 22 lies and they are also generally perpendicular to the axis of rotation of the ratchet mechanism. As may be appreciated, the plane in which the ratchet mechanism rotates, plane B, is parallel to the plane in which the lever arm rotates, i.e., plane A. The conventional telescoping arm provides for and accommodates a range of arm lengths. The handle extends back toward the patient and during use of the device may be gripped by the patient's hand or used as a support for the patient's hand, either front side or back side. With reference to FIGS. 6 and 8, the ratchet mechanism includes a gear or toothed wheel positioned inside of a housing and fastened about the axle for rotation in either the clockwise direction or counterclockwise direction. A U-shaped brake 44 is rotatingly attached to one side of the housing, and extends exterior to the housing in the form of a release and reverse lever 34. As shown in FIG. 6, the lever 34 operates as a brake against rotation in a clockwise direction. By rotating the lever 34 in a clockwise direction the brake 44 is also rotated clockwise to a position against the wheel 42 at which it operates as a brake against counterclockwise direction. The housing is fastened to the base via conventional fasteners 36, such as screws, rivets, staples, nails, glue or any other means so long as they function to keep the housing fastened to the base. FIG. 7 illustrates the positioning of a user's body, particularly the shoulder, upper arm, forearm and hand in relation to the various parts of the shoulder stretcher mechanism. Alternate embodiments operate in a similar fashion, although in the preferred alternate embodiment a unitary arm having a slidably adjustable handle assembly is used rather than a telescoping arm.

As shown in FIG. 8 for the first preferred embodiment, an optional forearm rest 48 may be provided, as shown, for example, positioned on the lever arm 30. The forearm rest functions to provide a stable support for the forearm. The end of the lever arm 30 distal from the ratchet mechanism 32 is formed into a "U" shape, with the closed end of the "U" forming a handgrip 50. The handgrip may be made of any of a variety of materials, such as cloth, a rubber or elastomeric material, or an absorbent material. A sling 52 is positioned on the legs of the "U" and extends between the "U" to form and function as a forearm rest. A strap 54 is preferably fastened to one of the legs of the "U" and extends across, and is attachable at the opposite let of the "U". The strap 54 functions to provide a restraint for the forearm in one direction of rotation, and as the forearm rest in the opposite direction of rotation. The strap 54 is preferably fastened to one leg with a hook and loop type fastener. Various types of materials may be used for, and various techniques may be used to fasten the forearm sling and forearm strap to the lever arm 30. In yet another alternate embodiment, the lever arm may be in the form of a horseshoe with elongated legs of the same length, the distal ends of which are fastened to the axle of the ratchet mechanism. In this alternate embodiment webbing, a solid surface or some other material extends between the elongated legs and then along the length of the lever arm to function as a forearm rest or support. The elongated horseshoe lever arm may also be of a telescoping design capable of adjustment to accommodate arms of different length.

The various embodiments of the shoulder stretcher are designed to address tightness of the posterior capsule of the glenohumeral joint (shoulder) that is an extremely common problem that occurs secondary to a minor shoulder problem. It is a real problem in throwing athletes, post-operative patients, and patients with a diagnosis of impingement syndrome of the shoulder, the most common source of shoulder pain. These shoulder stretchers are designed primarily for posterior capsule stretching, although they also could be used for internal stretching simply by reversing the orientation of the user with respect to the device during use. During use the patient lies on the side of the pathology, and then straps the arm into the device. Next, using the ratchet mechanism, the arm is bent towards the floor in the vicinity of the hip on the same side of the shoulder problem. This bending is in general a rotation with the upper arm as the axis of rotation, and with the upper arm extending in general along the base centerline. Thus, in general the axis of rotation of the upper arm and the axis of rotation of the ratchet mechanism are parallel, and for example, as shown in FIG. 1 preferably would also be parallel to the centerline 21. The device is designed primarily for rotation in one direction that stretches the posterior capsule. The reason for 180° of motion is to allow for right or left use with the same unit. Thus, for each arm the device can be rotated in the clockwise direction as well as in the counter-clockwise direction. For example, as shown in FIG. 7 the user's right arm is positioned for rotation in the counter-clockwise direction, so that posterior capsule stretching takes place during the rotation. When the device is used on the left arm, the direction of rotation is clockwise for posterior capsule stretching. When during use the right arm is rotated in the clockwise direction the interior stretching takes place.

When stretching the shoulder with this device, the patient lies on the platform or base, preferably padded and made of a plastic material, then turns on the side of the injured shoulder. The strap (or straps if more than one strap is used) is placed across the arm between the elbow and the shoulder is tightened sufficiently to prevent the upper arm from lifting up or rising during rotation of the arm of the user and lever arm of the device. The optional forearm rest, if used, provides a surface on which the forearm rests while the hand grips the handgrip of the lever arm for support. The patient then uses the other arm to pull or rotate the lever arm and arm towards the floor adjacent to the hip. As the forearm rest advances or rotates incrementally toward the floor, as each increment of rotation is accomplished, the ratchet mechanism prevents reverse rotation of the forearm rest back toward its starting position. With this ratcheting capability, the patient can sequentially rotate the arm to a first desired rotational position, then stop and rest the shoulder with the lever arm locked in that position. After resting a desired period, the patient can resume rotation until a second desired rotational position is achieved, and again stop rotation to rest the shoulder. The patent can then continue the sequence of rotation, rest, rotation, rest, rotation, etc., until a final desired position of stretching is achieved for a given therapy session. Then the patent can release the ratchet, so that the lever arm and patient's arm can be reverse rotated back to the starting position.

By this sequential action and motion, the patient sequentially stretches the posterior capsule and holds it in a stretched position. The user rotates the lever arm to a position that can be tolerated, and then waits for the shoulder to stretch. After a while, the shoulder is stretched and the user can advance, or further rotate the level arm, and the attached forearm of the user to further stretch the shoulder. This cycle or sequence of rotation, rest; further rotation, rest; further rotation, etc., takes place for a desired number of times at the choice of the user during each session. The user also chooses the number of sessions, preferably under the direction of his or her treating physician. The sessions and stretching operations are continued until the shoulder capsule has been stretched sufficient to return the shoulder to normal ranges of motion, or otherwise to a position of acceptable stretching for that particular patient. During each stretching session, once the shoulder has been stretched adequately, or to some desired position of rotation for that session, the release button is pressed to release the ratchet brake, and to permit reverse rotation of the forearm rest and the ratchet mechanism to their original, starting positions. Thus, the patient may gradually and progressively stretch his or her shoulder joint in both internal and external rotation.

Although specific embodiments of the invention have been described, various modifications, alterations, alternative constructions, and equivalents are also encompassed within the scope of the invention.

The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

What is claimed is:

1. A human shoulder posterior capsule stretching device comprising:

a base having a predetermined length, width and longitudinal centerline;

a first arm strap positioned on the base, having a predetermined length and width, and adapted to hold an upper arm of a user against the base during use;

a ratchet mechanism positioned on the base, the ratchet mechanism having an axle with an axis of rotation about a horizontal line lying in a vertical plane passing through the centerline of the base;

a lever arm having a first end fastened to the ratchet mechanism axle and adapted to rotate about the axis of rotation of the ratchet mechanism, a second end having a handle, and an adjustable length;

said ratchet mechanism configured to permit progressive stretching of the shoulder posterior capsule of the user by sequential rotation of said lever arm and interruption of said sequential rotation, wherein said lever arm is held at a predetermined position and reverse rotation of said lever arm is prevented; and, a second arm strap positioned on the base between the first arm strap and the ratchet mechanism, having a predetermined length and width, and adapted to hold the upper arm of the user against the base and at the distal end of the upper arm;

whereby the posterior capsule of the user's shoulder may be stretched upon rotation of the lever arm.

2. The shoulder stretcher of claim 1, wherein said ratchet mechanism includes a ratchet release.

3. A method of posterior capsule stretching of a shoulder of a person in a desired plane comprising:

providing a base having a predetermined length, width and longitudinal centerline;

providing a first arm strap positioned on the base, having a predetermined length and width, and adapted to hold against the base the person's upper arm located on the same side of the person's body as the shoulder;

providing a ratchet mechanism positioned on the base, the ratchet mechanism having an axle with an axis of rotation about a horizontal line lying in a vertical plane passing through the centerline of the base and parallel to the desired plane;

providing a release mechanism for the ratchet mechanism;

providing a lever arm having a first end fastened to the axle of the ratchet mechanism, a second end having a handle, and an adjustable length; and, providing a second arm strap positioned on the base between the first arm strap and the ratchet mechanism, having a predetermined length and width, and adapted to hold the upper part of the arm against the base during use;

strapping the upper arm in the first arm strap and in the second arm strap with sufficient tightness to prevent the upper arm from lifting from the base during stretching;

gripping the lever arm handle;

progressively stretching the shoulder by sequential rotation of the lever arm and interruption of rotation comprising:

rotating the lever arm to rotate the shoulder in the desired plane from a first position to a second position, thereby stretching the posterior capsule of the shoulder;

sustaining the shoulder in the second position for a first period by stopping the rotating of the lever arm, wherein reverse rotation of the lever arm from the second position is prevented by the ratchet mechanism;

rotating the lever arm to rotate the shoulder in the desired plane from the second position to a third position, thereby further stretching the posterior capsule of the shoulder; and, sustaining the shoulder in the third position for a second period, wherein reverse rotation of the lever arm from the third position is prevented by the ratchet mechanism.

4. The method of claim 3 including repeating the sequential rotation of the lever arm for a desired number of periods.

5. The method of claim 4 including activating the release mechanism after the desired number of periods.

6. A human shoulder posterior capsular stretching device comprising:

a base having a predetermined length, width and longitudinal centerline;

a shoulder strap positioned on the base, having a predetermined shape, and adapted to hold a shoulder of a user against the base during use;

a ratchet mechanism positioned on the base, the ratchet mechanism having an axle with an axis of rotation about a horizontal line lying in a vertical plane passing through the centerline of the base;

a lever arm having a first end fastened to the ratchet mechanism axle and adapted to rotate about the axis of rotation of the ratchet mechanism, and a second end having a handle and a member adapted to stabilize the wrist of the user;

said ratchet mechanism configured to permit progressive stretching of the shoulder posterior capsule of the user by sequential rotation of said lever arm and interruption of said sequential rotation, wherein said lever arm is held at a predetermined position and reverse rotation of said lever arm is prevented;

whereby the posterior capsule of the user's shoulder may be stretched upon rotation of the lever arm.

7. The shoulder stretcher of claim 6 wherein said lever arm includes an elbow pad.

8. The shoulder stretcher of claim 6 wherein said lever arm is adjustable in length.

9. The shoulder stretcher of claim 6 wherein said lever arm includes a slot extending along its length.

10. The shoulder stretcher of claim 6 wherein said lever arm includes a slot extending along its length, a handle assembly moveably attached to said lever arm along said slot.

11. The shoulder stretcher of claim 6, further including an indicator adapted to display the degree of rotation of the lever arm during use.

12. The shoulder stretcher of claim 6, wherein said shoulder strap is secured at three locations in relation to said base.

13. The shoulder stretcher of claim 6, wherein said shoulder strap is adapted to be positioned at various locations with respect to said lever arm.

14. The shoulder stretcher of claim 6, wherein said shoulder strap is adapted to be positioned at various heights relative to said base.

15. A human shoulder posterior capsule stretching device comprising:

a base having a predetermined length, width and longitudinal centerline, a surface of said base being oriented in a plane substantially parallel to and tangential to a human user's back;

a first arm strap positioned on the base, having a predetermined length and width, and adapted to hold an upper arm of the user against the base during use;

a ratchet mechanism positioned on the base, the ratchet mechanism having an axle with an axis of rotation about a horizontal line lying in a plane orthogonal to the plane of the base and passing through the centerline of the base;

a lever arm having a first end fastened to the ratchet mechanism axle and adapted to rotate about the axis of rotation of the ratchet mechanism, a second end having a roughly-cylindrical handle, and an adjustable length;

said ratchet mechanism configured to permit progressive stretching of the shoulder posterior capsule of the user by sequential rotation of said lever arm and interruption of said sequential rotation, wherein said lever arm is held at a predetermined position and reverse rotation of said lever arm is prevented; and, a second arm strap positioned on the base between the first arm strap and the ratchet mechanism, having a predetermined length and width, and adapted to hold the upper arm of the user against the base and at the distal end of the upper arm;

whereby the posterior capsule of the user's shoulder may be stretched upon rotation of the lever arm.

* * * * *